US007435165B2

(12) United States Patent
Prasad

(10) Patent No.: US 7,435,165 B2
(45) **Date of Patent: *Oct. 14, 2008**

(54) TRANSPARENT MICROPOROUS MATERIALS FOR CMP

(75) Inventor: Abaneshwar Prasad, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 865 days.

This patent is subject to a terminal disclaimer.

(21) Appl. No.: 10/282,489

(22) Filed: Oct. 28, 2002

(65) Prior Publication Data

US 2004/0082276 A1 Apr. 29, 2004

(51) Int. Cl.
*B24D 11/00* (2006.01)
*B24D 5/00* (2006.01)
*B24B 1/00* (2006.01)

(52) U.S. Cl. ..... 451/526; 451/41; 451/285

(58) Field of Classification Search ..... 451/526, 451/41, 6, 8, 527, 528, 533, 285; 51/295–298, 51/303

See application file for complete search history.

(56) References Cited

U.S. PATENT DOCUMENTS

| | | | | |
|---|---|---|---|---|
| 4,138,228 | A | 2/1979 | Hartfelt et al. | |
| 4,239,567 | A | 12/1980 | Winings | |
| 4,954,141 | A | 9/1990 | Takiyama et al. | |
| 5,182,307 | A | 1/1993 | Kumar | |
| 5,489,233 | A | 2/1996 | Cook et al. | |
| 5,605,760 | A | 2/1997 | Roberts | |
| 5,628,862 | A | 5/1997 | Yu et al. | |
| 5,684,055 | A | 11/1997 | Kumar et al. | |
| 5,893,796 | A | 4/1999 | Birang et al. | |
| 5,964,643 | A | 10/1999 | Birang et al. | |
| 6,022,268 | A | 2/2000 | Roberts et al. | |
| 6,045,439 | A | 4/2000 | Birang et al. | |
| 6,062,968 | A | 5/2000 | Sevilla et al. | |
| 6,089,965 | A | 7/2000 | Otawa et al. | |
| 6,120,353 | A | 9/2000 | Suzuki et al. | |
| 6,146,242 | A | 11/2000 | Treur et al. | |
| 6,169,122 | B1 | 1/2001 | Bizard et al. | |
| 6,171,181 | B1 | 1/2001 | Roberts et al. | |
| 6,231,942 | B1 | 5/2001 | Blizard et al. | |
| 6,235,380 | B1 | 5/2001 | Tupil et al. | |
| 6,245,406 | B1 | 6/2001 | Kuramochi et al. | |
| 6,248,000 | B1 * | 6/2001 | Aiyer | 451/41 |
| 6,261,155 | B1 * | 7/2001 | Jairath et al. | 451/41 |
| 6,284,810 | B1 | 9/2001 | Burnham et al. | |
| 6,328,644 | B1 | 12/2001 | Kuramochi et al. | |
| 6,358,130 | B1 | 3/2002 | Freeman et al. | |
| 6,368,200 | B1 | 4/2002 | Merchant et al. | |
| 6,425,816 | B1 * | 7/2002 | Roberts et al. | 451/533 |
| 6,428,586 | B1 * | 8/2002 | Yancey | 51/297 |
| 6,435,947 | B2 * | 8/2002 | Mueller et al. | 451/41 |
| 6,454,634 | B1 * | 9/2002 | James et al. | 451/41 |
| 6,537,134 | B2 * | 3/2003 | Newell | 451/6 |
| 6,641,471 | B1 * | 11/2003 | Pinheiro et al. | 451/526 |
| 2001/0053658 | A1 | 12/2001 | Budinger et al. | |
| 2002/0010232 | A1 | 1/2002 | Ogawa et al. | |
| 2002/0016146 | A1 * | 2/2002 | Kuramochi et al. | 451/528 |
| 2002/0072296 | A1 | 6/2002 | Muilenburg et al. | |
| 2002/0098790 | A1 | 7/2002 | Burke | |
| 2002/0123300 | A1 * | 9/2002 | Jones et al. | 451/41 |

FOREIGN PATENT DOCUMENTS

| | | | |
|---|---|---|---|
| EP | 1 046 466 | A2 | 10/2000 |
| EP | 1 108 500 | A1 | 6/2001 |
| EP | 1211024 | A2 | 6/2002 |
| WO | WO 98/28108 | A1 | 7/1998 |
| WO | WO 00/59702 | A1 | 10/2000 |
| WO | WO 01/15863 | A1 | 3/2001 |
| WO | WO 01/15885 | A1 | 3/2001 |
| WO | WO 01/36521 | A2 | 5/2001 |
| WO | WO 01/68322 | A1 | 9/2001 |
| WO | WO 01/94074 | A1 | 12/2001 |
| WO | WO 02/02274 | A2 | 1/2002 |
| WO | WO 02/09907 | A1 | 2/2002 |

* cited by examiner

*Primary Examiner*—Hadi Shakeri
(74) *Attorney, Agent, or Firm*—Thomas E. Omholt; Caryn Borg-Breen; Francis J. Koszyk

(57) ABSTRACT

The invention is directed to a chemical-mechanical polishing pad substrate comprising a porous material having an average pore size of about 0.01 microns to about 1 micron. The polishing pad substrate has a light transmittance of about 10% or more at at least one wavelength of about 200 nm to about 35,000 nm. The invention is further directed to a polishing pad comprising the polishing pad substrate, a method of polishing comprising the use of the polishing pad substrate, and a chemical-mechanical apparatus comprising the polishing pad substrate.

15 Claims, 1 Drawing Sheet

TRANSPARENT MICROPOROUS MATERIALS FOR CMP

FIELD OF THE INVENTION

This invention pertains to a polishing pad substrate comprising a transparent porous material for use with in situ chemical-mechanical polishing detection methods.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

In polishing the surface of a wafer, it is often advantageous to monitor the polishing process in situ. One method of monitoring the polishing process in situ involves the use of a polishing pad having an aperture or window. The aperture or window provides a portal through which light can pass to allow the inspection of the wafer surface during the polishing process. Polishing pads having apertures and windows are known and have been used to polish substrates, such as the surface of semiconductor devices. For example, U.S. Pat. No. 5,605,760 provides a pad having a transparent window formed from a solid, uniform polymer, which has no intrinsic ability to absorb or transport slurry. U.S. Pat. No. 5,433,651 discloses a polishing pad wherein a portion of the pad has been removed to provide an aperture through which light can pass. U.S. Pat. Nos. 5,893,796 and 5,964,643 disclose removing a portion of a polishing pad to provide an aperture and placing a transparent polyurethane or quartz plug in the aperture to provide a transparent window, or removing a portion of the backing of a polishing pad to provide a translucency in the pad. U.S. Pat. Nos. 6,171,181 and 6,387,312 disclose a polishing pad having a transparent region that is formed by solidifying a flowable material (e.g., polyurethane) at a rapid rate of cooling.

Only a few materials have been disclosed as useful for polishing pad windows. U.S. Pat. No. 5,605,760 discloses the use of a solid piece of polyurethane. U.S. Pat. Nos. 5,893,796 and 5,964,643 disclose the use of either a polyurethane plug or a quartz insert. U.S. Pat. No. 6,146,242 discloses a polishing pad with a window comprising either polyurethane or a clear plastic such as Clariflex™ tetrafluoroethylene-co-hexafluoropropylene-co-vinylidene fluoride terpolymer sold by Westlake. Polishing pad windows made of a solid polyurethane are easily scratched during chemical-mechanical polishing, resulting in a steady decrease of the optical transmittance during the lifetime of the polishing pad. This is particularly disadvantageous because the settings on the endpoint detection system must be constantly adjusted to compensate for the loss in optical transmittance. In addition, pad windows, such as solid polyurethane windows, typically have a slower wear rate than the remainder of the polishing pad, resulting in the formation of a "lump" in the polishing pad which leads to undesirable polishing defects. To address some of these problems, WO 01/683222 discloses a window having a discontinuity that increases the wear rate of the window during CMP. The discontinuity purportedly is generated in the window material by incorporating into the window either a blend of two immiscible polymers or a dispersion of solid, liquid, or gas particles.

While many of the known window materials are suitable for their intended use, there remains a need for effective polishing pads having translucent regions that can be produced using efficient and inexpensive methods and provide constant light transmissivity over the lifetime of the polishing pad. The invention provides such a polishing pad, as well as methods of its use. These and other advantages of the present invention, as well as additional inventive features, will be apparent from the description of the invention provided herein.

BRIEF SUMMARY OF THE INVENTION

The invention provides a chemical-mechanical polishing pad substrate comprising a porous material having an average pore size of about 0.01 microns to about 1 micron, wherein the polishing pad substrate has a light transmittance of about 10% or more at at least one wavelength of about 200 nm to about 35,000 nm. The invention further provides a chemical-mechanical polishing apparatus and method of polishing a workpiece. The CMP apparatus comprises (a) a platen that rotates, (b) a polishing pad comprising the polishing pad substrate of the invention, and (c) a carrier that holds a workpiece to be polished by contacting the rotating polishing pad. The method of polishing comprises the steps of (i) providing a polishing pad comprising the polishing pad substrate of the invention, (ii) contacting a workpiece with the polishing pad, and (iii) moving the polishing pad relative to the workpiece to abrade the workpiece and thereby polish the workpiece.

DETAILED DESCRIPTION OF THE INVENTION

Figure 1:
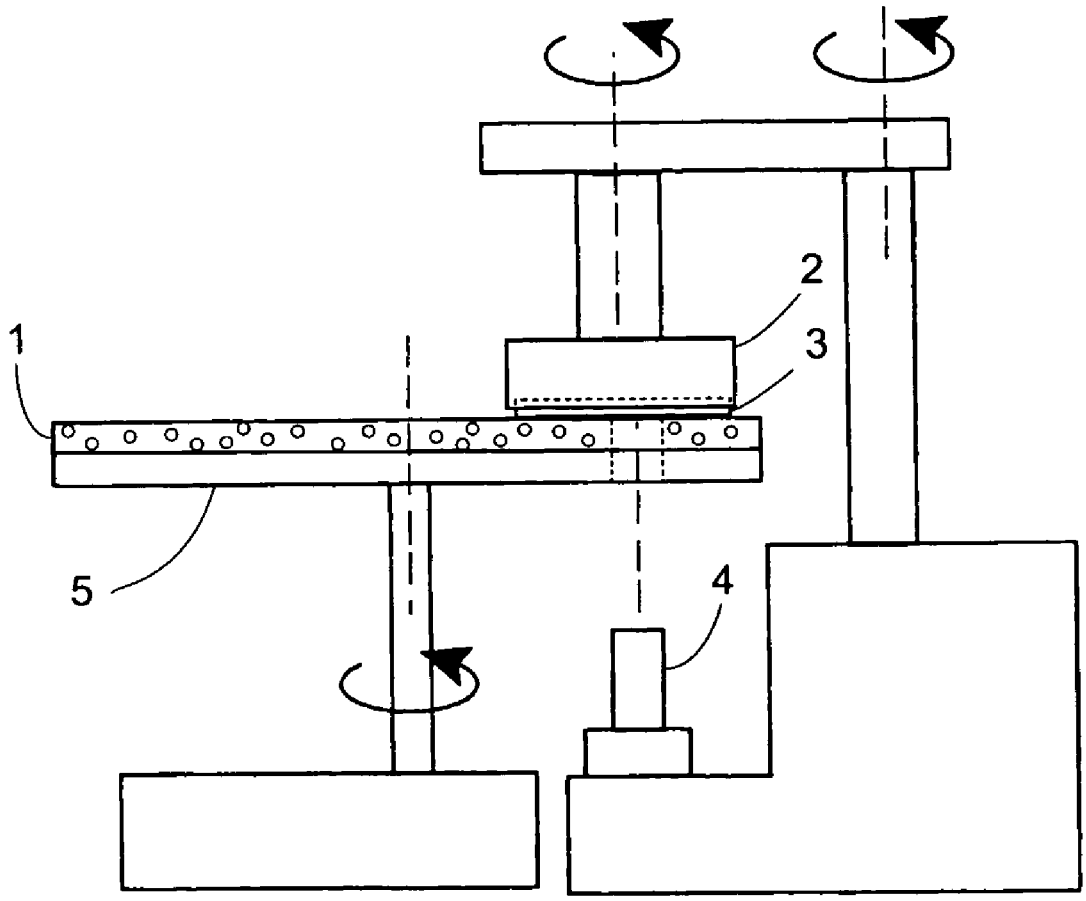
FIG. 1 depicts a chemical-mechanical polishing (CMP) apparatus in accordance with one embodiment of the invention.

The invention is directed to a chemical-mechanical polishing pad substrate comprising a porous material, wherein the polishing pad substrate has at least a certain degree of transparency. The polishing pad substrate can be a portion within a polishing pad, or the polishing pad substrate can be an entire polishing pad (e.g., the entire polishing pad or polishing top pad is transparent). In some embodiments, the polishing pad substrate consists of, or consists essentially of, the porous material. The polishing pad substrate comprises a volume of the polishing pad that is at least 0.5 $cm^3$ (e.g., at least about 1 $cm^3$).

The porous material of the polishing pad substrate has an average pore size of about 0.01 microns to about 1 micron. Preferably, the average pore size is about 0.05 microns to about 0.9 microns (e.g., about 0.1 microns to about 0.8 microns). While not wishing to be bound to any particular theory, it is believed that pore sizes greater than about 1 micron will scatter incident radiation, while pore size less than about 1 micron will scatter less incident radiation, or will not scatter the incident radiation at all, thereby providing the polishing pad substrate with a desirable degree of transparency.

The porous material of the polishing pad substrate has a highly uniform distribution of pore sizes (i.e., cell sizes). Typically, about 75% or more (e.g., about 80% or more, or about 85% or more) of the pores (e.g., cells) in the porous material have a pore size distribution of about ±0.5 μm or less (e.g., about ±0.3 μm or less, or about ±0.2 μm or less). In other words, about 75% or more (e.g., about 80% or more, or about 85% or more) of the pores in the porous material have a pore size within about 0.5 μm or less (e.g., about 0.3 μm or less, or about 0.2 μm or less) of the average pore size. Preferably, about 90% or more (e.g., about 93% or more, or about 95% or more) of the pores (e.g., cells) in the porous material have a pore size distribution of about ±0.5 μm or less (e.g., about ±0.3 μm or less, or about ±0.2 μm or less).

Typically, the porous material of the polishing pad substrate comprises predominantly closed cells (i.e., pores); however, the porous material can also comprise open cells. Preferably, the porous material comprises at least about 10% or more (e.g., at least about 20% or more) closed cells. More preferably, the porous material comprises at least about 30% or more (e.g., at least about 50% or more, or at least about 70% or more) closed cells.

The porous material of the polishing pad substrate can have any suitable density or void volume. Typically, the porous material has a density of about 0.2 $g/cm^3$ or greater (e.g., about 0.3 $g/cm^3$ or greater, or even about 0.4 $g/cm^3$ or greater), preferably a density of about 0.5 $g/cm^3$ or greater (e.g., about 0.7 $g/cm^3$ or greater, or even about 0.9 $g/cm^3$ or greater). The void volume typically is about 90% or less (e.g., about 75% or less, or even about 50% or less), preferably about 25% or less (e.g., about 15% or less, about 10% or less, or even about 5% or less). Typically the porous material has a cell density of about $10^5$ cells/$cm^3$ or greater (e.g., about $10^6$ cells/$cm^3$ or greater). The cell density is determined by analyzing a cross-sectional image (e.g., an SEM image) of a porous material with an image analysis software program such as Optimas® imaging software and ImagePro® imaging software, both by Media Cybernetics, or Clemex Vision® imaging software by Clemex Technologies.

The porous material of the polishing pad substrate can comprise any suitable material and typically comprises a polymer resin. The porous material preferably comprises a polymer resin selected from the group consisting of thermoplastic elastomers, thermoplastic polyurethanes, polyolefins, polycarbonates, polyvinylalcohols, nylons, elastomeric rubbers, styrenic polymers, polyaromatics, fluoropolymers, polyimides, cross-linked polyurethanes, cross-linked polyolefins, polyethers, polyesters, polyacrylates, elastomeric polyethylenes, polytetrafluoroethylene, polyethyleneterephthalate, polyimides, polyaramides, polyarylenes, polystyrenes, polymethylmethacrylates, copolymers and block copolymers thereof, and mixtures and blends thereof. Preferably, the polymer resin is thermoplastic polyurethane.

The polymer resin typically is a pre-formed polymer resin; however, the polymer resin also can be formed in situ according to any suitable method, many of which are known in the art (see, for example, *Szycher's Handbook of Polyurethanes*, CRC Press: New York, 1999, Chapter 3). For example, thermoplastic polyurethane can be formed in situ by reaction of urethane prepolymers, such as isocyanate, di-isocyanate, and tri-isocyanate prepolymers, with a prepolymer containing an isocyanate reactive moiety. Suitable isocyanate reactive moieties include amines and polyols.

The selection of the polymer resin will depend, in part, on the rheology of the polymer resin. Rheology is the flow behavior of a polymer melt. For Newtonian fluids, the viscosity is a constant defined by the ratio between the shear stress (i.e., tangential stress, $\sigma$) and the shear rate (i.e., velocity gradient, $d\gamma/dt$). However, for non-Newtonian fluids, shear rate thickening (dilatent) or shear rate thinning (pseudo-plastic) may occur. In shear rate thinning cases, the viscosity decreases with increasing shear rate. It is this property that allows a polymer resin to be used in melt fabrication (e.g., extrusion, injection molding) processes. In order to identify the critical region of shear rate thinning, the rheology of the polymer resins must be determined. The rheology can be determined by a capillary technique in which the molten polymer resin is forced under a fixed pressure through a capillary of a particular length. By plotting the apparent shear rate versus viscosity at different temperatures, the relationship between the viscosity and temperature can be determined. The Rheology Processing Index (RPI) is a parameter that identifies the critical range of the polymer resin. The RPI is the ratio of the viscosity at a reference temperature to the viscosity after a change in temperature equal to 20° C. for a fixed shear rate. When the polymer resin is thermoplastic polyurethane, the RPI preferably is about 2 to about 10 (e.g., about 3 to about 8) when measured at a shear rate of about 150 1/s and a temperature of about 205° C.

Another polymer viscosity measurement is the Melt Flow Index (MFI) which records the amount of molten polymer (in grams) that is extruded from a capillary at a given temperature and pressure over a fixed amount of time. For example, when the polymer resin is thermoplastic polyurethane or polyurethane copolymer (e.g., a polycarbonate silicone-based copolymer, a polyurethane fluorine-based copolymers, or a polyurethane siloxane-segmented copolymer), the MFI preferably is about 20 or less (e.g., about 15 or less) over 10 minutes at a temperature of 210° C. and a load of 2160 g. When the polymer resin is an elastomeric polyolefin or a polyolefin copolymer (e.g., a copolymer comprising an ethylene $\alpha$-olefin such as elastomeric or normal ethylene-propylene, ethlene-hexene, ethylene-octene, and the like, an elastomeric ethylene copolymer made from metallocene based catalysts, or a polypropylene-styrene copolymer), the MFI preferably is about 5 or less (e.g., about 4 or less) over 10 minutes at a temperature of 210° C. and a load of 2160 g. When the polymer resin is a nylon or polycarbonate, the MFI preferably is about 8 or less (e.g., about 5 or less) over 10 minutes at a temperature of 210° C. and a load of 2160 g.

The rheology of the polymer resin can depend on the molecular weight, polydispersity index (PDI), the degree of long-chain branching or cross-linking, glass transition temperature ($T_g$), and melt temperature ($T_m$) of the polymer resin. When the polymer resin is thermoplastic polyurethane or polyurethane copolymer (such as the copolymers described above), the weight average molecular weight ($M_w$) is typically about 50,000 g/mol to about 300,000 g/mol, preferably about 70,000 g/mol to about 150,000 g/mol, with a PDI of about 1.1 to about 6, preferably about 2 to about 4. Typically, the thermoplastic polyurethane has a glass transition temperature of about 20° C. to about 110° C. and a melt transition temperature of about 120° C. to about 250° C. When the polymer resin is an elastomeric polyolefin or a polyolefin copolymer (such as the copolymers described above), the weight average molecular weight ($M_w$) typically is about 50,000 g/mol to about 400,000 g/mol, preferably about 70,000 g/mol to about 300,000 g/mol, with a PDI of about 1.1 to about 12, preferably about 2 to about 10. When the polymer resin is nylon or polycarbonate, the weight average molecular weight ($M_w$) typically is about 50,000 g/mol to about 150,000 g/mol, preferably about 70,000 g/mol to about 100,000 g/mol, with a PDI of about 1.1 to about 5, preferably about 2 to about 4.

The polymer resin selected for the porous material preferably has certain mechanical properties. For example, when the polymer resin is a thermoplastic polyurethane, the Flexural Modulus (ASTM D790) preferably is about 350 MPa (~50,000 psi) to about 1000 MPa (~150,000 psi), the average % compressibility is about 7 or less, the average % rebound is about 35 or greater, and the Shore D hardness (ASTM D2240-95) is about 40 to about 90 (e.g., about 50 to about 80).

The polishing pad substrate has a light transmittance of about 10% or more (e.g., about 20% or more) at at least one wavelength in the range of about 200 nm to about 35,000 nm. Preferably, the porous material has a light transmittance of about 30% or more (e.g., about 40% or more, or even about 50% or more) at at least one wavelength in the range of about 200 nm to about 35,000 nm (e.g., about 200 nm to about 10,000 nm, or about 200 nm to about 1,000 nm, or even about 200 nm to about 800 nm). The light transmittance of the polishing pad substrate is at least in part determined by controlling properties of the porous material selected from the group consisting of density, void volume, Flexural Modulus, and combinations thereof.

The polishing pad substrate of the invention offers improved consistency of the light transmittance over the lifetime of the polishing pad substrate. This feature arises from the fact that the pores are present throughout the thickness of the polishing pad substrate. Thus, when the surface layer is removed during polishing, the subsequent layers beneath the surface have substantially similar porosity and roughness, and thus have substantially similar polishing properties and light transmittance properties to the top surface layer. In addition, the transmissivity of the polishing pad substrate is on average lower than the same material without pores because of the roughness, and so the percentage change in light scattering due to any change resulting from abrasion of the polishing pad substrate during polishing is also lessened. Desirably, the light transmittance of the polishing pad substrate decreases by less than about 20% (e.g., less than about 10%, or even less than about 5%) over the lifetime of the polishing pad substrate. These changes, taken together, will lessen or even obviate the need to adjust the gain of the endpoint detection system over the lifetime of the polishing pad substrate. For example, the consistency in light transmittance of the polishing pad substrate of the invention can be compared to a solid, or nearly solid, polyurethane window of the prior art. Before polishing, solid polyurethane windows have consistent surface properties; however, during polishing the window becomes abraded and scratched giving rise to inconsistent surface properties. Therefore, an endpoint detection system must be constantly adjusted in response to each new pattern of scratches that arises during polishing. Contrastingly, the polishing pad substrate of the invention begins with a roughened surface that remains substantially unchanged during and after abrasion during polishing such that the endpoint detection settings can remain substantially unchanged over the lifetime of the polishing pad substrate.

The presence of pores in the polishing pad substrate of the invention can have a significant effect on the polishing properties. For example, in some cases, the pores are capable of absorbing and transporting polishing slurry. Thus, the transmissive region can have polishing properties that are more similar to the remaining portions of the polishing pad. In some embodiments, the surface texture of the transmissive polishing pad substrate is sufficient to make the polishing pad substrate useful as a polishing surface without the need for a second, opaque portion of the polishing pad that is used exclusively for polishing.

The polishing pad substrate of the invention optionally further comprises a dye, which enables the substrate to selectively transmit light of a particular wavelength(s). The dye acts to filter out undesired wavelengths of light (e.g., background light) and thus improve the signal to noise ratio of detection. The polishing pad substrate can comprise any suitable dye or may comprise a combination of dyes. Suitable dyes include polymethine dyes, di-and tri-arylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 540 to 570 nm, the dye preferably is a red dye.

The polishing pad substrate of the invention can be produced using any suitable technique, many of which are known in the art. For example, the polishing pad substrate can be produced by (a) a mucell process, (b) a sol-gel process, (c) a phase inversion process, (d) a spinodal or bimodal decomposition process, or (e) a pressurized gas injection process.

The mucell process involves (a) combining a polymer resin with a supercritical gas to produce a single-phase solution and (b) forming a polishing pad substrate of the invention from the single-phase solution. The polymer resin can be any of the polymer resins described above. A supercritical gas is generated by subjecting a gas to an elevated temperature (e.g., about 100° C. to about 300° C.) and pressure (e.g., about 5 MPa (~800 psi) to about 40 MPa (~6000 psi)) sufficient to create a supercritical state in which the gas behaves like a fluid (i.e., a supercritical fluid, SCF). The gas can be a hydrocarbon, chlorofluorocarbon, hydrochlorofluorocarbon (e.g., freon), nitrogen, carbon dioxide, carbon monoxide, or a combination thereof. Preferably, the gas is a non-flammable gas, for example a gas that does not contain C—H bonds. The single-phase solution of the polymer resin and the supercritical gas typically is prepared by blending the supercritical gas with molten polymer resin in a machine barrel. The single-phase solution then can be injected into a mold, where the gas expands to form a pore structure with high uniformity of pore size within the molten polymer resin. The concentration of the supercritical gas in the single-phase solution typically is about 0.01% to about 5% (e.g., about 0.1% to about 3%) of the total volume of the single-phase solution. These and additional process features are described in further detail in U.S. Pat. No. 6,284,810. The microcellular structure is formed by creating a thermodynamic instability in the single-phase solution (e.g., by rapidly changing the temperature and/or pressure) sufficient to produce greater than about $10^5$ nucleation sites per $cm^3$ of the solution. Nucleation sites are the sites at which the dissolved molecules of the supercritical gas form clusters from which the cells in the porous material grow. The number of nucleation sites is estimated by assuming that the number of nucleation sites is approximately equal to the number of cells formed in the polymer material. Typically, the thermodynamic instability is induced at the exit of the mold or die which contains the single-phase solution. The porous material can be formed from the single-phase solution by any suitable technique including extrusion into a polymer sheet, co-extrusion of multilayer sheets, injection molding, compression molding, blow molding, blown film, multilayer blown film, cast film, thermoforming, and lamination. Preferably, the polishing pad substrate (e.g., the porous material) is formed by extrusion or injection molding. The pore size of the porous material is at least in part controlled by the temperature, pressure, and concentration of the supercritical gas, and combinations thereof.

The sol-gel process involves the preparation of a three-dimensional metal oxide network (e.g., siloxane network) having a controllable pore size, surface area, and pore size distribution. Such three-dimensional networks (i.e., sol-gels) can be prepared using a variety of methods, many of which are known in the art. Suitable methods include single-step (e.g., "one-pot") methods and two-step methods. In one method, a dilute, aqueous solution of silica (e.g., sodium silicate) is prepared which spontaneously condenses under appropriate pH and salt concentration conditions, to form the silicon-based network. Another typical method involves the use of metal alkoxide precursors (e.g., $M(OR)_4$, wherein M is Si, Al, Ti, Zr, or a combination thereof, and R is an alkyl, aryl, or a combination thereof) which when placed in a solvent containing water and an alcohol, undergo hydrolysis of the alkoxide ligands and condensation (e.g., polycondensation) resulting in the formation of M-O-M linkages (e.g., Si—O—Si siloxane linkages). Optionally, catalysts such as protic acids (e.g., HCl) and bases (e.g., ammonia) can be used to improve the kinetics of the hydrolysis and condensation reactions. Two-step methods typically involve the use of pre-polymerized precursors such as pre-polymerized tetraethyl orthosilicate (TEOS). As the number of M-O-M linkages increases, a three-dimensional network is formed which contains pores that are filled with solvent (e.g., water). The solvent can be exchanged with alcohol to form a structure referred to as an alcogel. Simple evaporation of the solvent typically leads to considerable destruction of the solid three-dimensional network resulting in the formation of a xerogel. A more preferred drying technique, which does not result in substantial destruction of the solid three-dimensional network, is supercritical extraction. Supercritical extraction typically involves combining the solid three-dimensional network with a suitable low molecular weight expanding agent (such as an alcohol, in particular methanol, as is present in an alcogel, or $CO_2$ gas which is accomplished by gas/solvent exchange) and applying a temperature and pressure to the mixture that is above the critical point of the expanding agent. Under these conditions, vitrification, cross-linking, or polymerization of the solid material can occur. The pressure is then slowly lowered to allow the expanding agent to diffuse out of the vitrified structure. The resulting sol-gel material, referred to as an aerogel, has a microcellular pore structure in which the average pore size and pore size distribution can be controlled. Such aerogel materials can be transparent to visible or ultraviolet light having a wavelength above 250 nm. Hybrid organic-inorganic sol-gel materials also can be transparent, or at least partially transparent. Hybrid sol-gel materials typically are prepared using chemical precursors containing both inorganic and organic groups. When a three-dimensional M-O-M network is formed from such precursors, the organic groups can become trapped inside the pore structure. The pore size can be controlled through the selection of an appropriate organic group. Examples of hybrid sol-gel materials include clay-polyamide hybrid materials and metal oxide-polymer hybrid materials.

The phase inversion process involves the dispersion of extremely fine particles of a polymer resin that have been heated above the $T_m$ or $T_g$ of the polymer in a highly agitated non-solvent. The polymer resin can be any of the polymer resins described above. The non-solvent can be any suitable solvent having a high Flory-Higgins polymer-solvent interaction parameter (e.g., a Flory-Higgins interaction parameter greater than about 0.5). Such polymer-solvent interactions are discussed in more detail in Ramanathan et al. in the following references: *Polymer Data Handbook*, Ed. James E. Mark, Oxford University Press, New York, p. 874, c. 1999; Oberth *Rubber Chem. and Technol.* 1984, 63, 56; Barton in *CRC Handbook of Solubility Parameters and Other Cohesion Parameters* CRC Press, Boca Raton, Fla., 1983, p. 256; and Prasad et al. *Macromolecules* 1989, 22, 914. For example, when the polymer resin is a thermoplastic polyurethane, an aromatic ether-based polyurethane, strongly polar solvents such as ethers, ketones, chloroform, dimethylformamide, and the like have interaction parameters less than 0.3 and will act as "good solvents" for the polymer. On the other hand, hydrocarbon solvents such as cyclohexane, cyclobutane, and n-alkanes have an interaction parameter greater than 0.5 and function as poor solvents or "non-solvents." The Flory-Higgins interaction parameter is sensitive to temperature so a solvent that is a good solvent at high temperatures may become a non-solvent at lower temperatures. As the number of fine polymer resin particles added to the non-solvent increases, the fine polymer resin particles connect to form initially as tendrils and ultimately as a three-dimensional polymer network. The non-solvent mixture is then cooled causing the non-solvent to form into discrete droplets within the three-dimensional polymer network. The resulting material is a polymer material having submicron pore sizes.

The spinodal or binodal decomposition process involves controlling the temperature and/or volume fraction of a polymer-polymer mixture, or a polymer-solvent mixture, so as to move the mixture from a single-phase region into a two-phase region. Within the two-phase region, either spinodal decomposition or binodal decomposition of the polymer mixture can occur. Decomposition refers to the process by which a polymer-polymer mixture changes from a nonequilibrium phase to an equilibrium phase. In the spinodal region, the free energy of mixing curve is negative such that phase separation of the polymers (i.e., formation of a two-phase material), or phase separation of the polymer and the solvent, is spontaneous in response to small fluctuations in the volume fraction. In the binodal region, the polymer mixture is stable with respect to small fluctuations in volume fraction and thus requires nucleation and growth to achieve a phase-separated material. Precipitation of the polymer mixture at a temperature and volume fraction within the two-phase region (i.e., the binodal or spinodal region) results in the formation of a polymer material having two phases. If the polymer mixture is laden with a solvent or a gas, the biphasic polymer material will contain sub-micron pores at the interface of the phase-separation. The polymers preferably comprise the polymer resins described above.

The pressurized gas injection process involves the use of high temperatures and pressures to force a supercritical fluid gas into a solid polymer sheet comprising a polymer resin. The polymer resin can be any of the polymer resins described above. Solid extruded sheets are placed at room temperature into a pressure vessel. A supercritical gas (e.g., $N_2$ or $CO_2$) is added to the vessel, and the vessel is pressurized to a level sufficient to force an appropriate amount of the gas into the free volume of the polymer sheet. The amount of gas dissolved in the polymer is directly proportional to the applied pressure according to Henry's law. Increasing the temperature of the polymer sheet increases the rate of diffusion of the gas into the polymer, but also decreases the amount of gas that can dissolve in the polymer sheet. Once the gas has thoroughly saturated the polymer, the sheet is removed from the pressurized vessel. The resulting polymer sheet typically has cell sizes ranging from about 0.5 microns to about 1 micron. If desired, the polymer sheet can be quickly heated to a softened or molten state. As with the mucell process, the pore size of the porous material is at least in part controlled by the temperature, pressure, and concentration of the supercritical gas, and combinations thereof.

When the polishing pad substrate of the invention constitutes only a portion of a polishing pad, the polishing pad substrate can be mounted into a polishing pad using any suitable technique. For example, the polishing pad substrate can be mounted into a polishing pad through the use of adhesives. The polishing pad substrate can be mounted into the top portion of the polishing pad (e.g., the polishing surface), or can be mounted into the bottom portion of the polishing pad (e.g., the subpad). The polishing pad substrate can have any suitable dimensions and can be round, oval, square, rectangular, triangular, and so on. The polishing pad substrate can be positioned so as to be flush with the polishing surface of the polishing pad, or can be recessed from the polishing surface of the polishing pad. The polishing pad can comprise one or more of the polishing pad substrates of the invention. The polishing pad substrate(s) can be placed in any suitable position on the polishing pad relative to the center and/or periphery of the polishing pad.

The polishing pad into which the polishing pad substrate is placed can be made of any suitable polishing pad material, many of which are known in the art. The polishing pad typically is opaque or only partially translucent. The polishing pad can comprise any suitable polymer resin. For example, the polishing pad typically comprises a polymer resin selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof, and mixtures thereof. The polishing pad can be produced by any suitable method including sintering, injection molding, blow molding, extrusion, and the like. The polishing pad can be solid and non-porous, can contain microporous closed cells, can contain open cells, or can contain a fibrous web onto which a polymer has been molded.

Polishing pads comprising the polishing pad substrate of the invention have a polishing surface which optionally further comprises grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY crosshatch pattern, and can be continuous or non-continuous in connectivity. Preferably, the polishing pad comprises at least small grooves produced by standard pad conditioning methods.

Polishing pads comprising the polishing pad substrate of the invention can comprise, in addition to the polishing pad substrate, one or more other features or components. For example, the polishing pad optionally can comprise regions of differing density, hardness, porosity, and chemical compositions. The polishing pad optionally can comprise solid particles including abrasive particles (e.g., metal oxide particles), polymer particles, water-soluble particles, water-absorbent particles, hollow particles, and the like.

Polishing pads comprising the polishing pad substrate of the invention are particularly suited for use in conjunction with a chemical-mechanical polishing (CMP) apparatus. Typically, as depicted in FIG. 1, the apparatus comprises a platen 5, which, when in use, is in motion and has a velocity that results from orbital, linear, or circular motion, a polishing pad 1 comprising the polishing pad substrate of the invention in contact with platen 5 and moving with the platen when in motion, and a carrier 2 that holds a workpiece 3 to be polished by contacting and moving relative to the surface of polishing pad 1. The polishing of the workpiece takes place by the workpiece being placed in contact with the polishing pad and then the polishing pad moving relative to the workpiece, typically with a polishing composition therebetween, so as to abrade at least a portion of the workpiece to polish the workpiece. The polishing composition typically comprises a liquid carrier (e.g., an aqueous carrier), a pH adjustor, and optionally an abrasive. Depending on the type of workpiece being polished, the polishing composition optionally may further comprise oxidizing agents, organic acids, complexing agents, pH buffers, surfactants, corrosion inhibitors, anti-foaming agents, and the like. The CMP apparatus can be any suitable CMP apparatus, many of which are known in the art. The polishing pad comprising the polishing pad substrate of the invention also can be used with linear polishing tools.

Desirably, the CMP apparatus further comprises an in situ polishing endpoint detection system 4, many of which are known in the art. Techniques for inspecting and monitoring the polishing process by analyzing light or other radiation reflected from a surface of the workpiece are known in the art. Such methods are described, for example, in U.S. Pat. Nos. 5,196,353, 5,433,651, 5,609,511, 5,643,046, 5,658,183, 5,730,642, 5,838,447, 5,872,633, 5,893,796, 5,949,927, and 5,964,643. Desirably, the inspection or monitoring of the progress of the polishing process with respect to a workpiece being polished enables the determination of the polishing end-point, i.e., the determination of when to terminate the polishing process with respect to a particular workpiece.

A polishing pad comprising the polishing pad substrate of the invention can be used alone or optionally can be used as one layer of a multi-layer stacked polishing pad. For example, the polishing pad can be used in combination with a subpad. The subpad can be any suitable subpad. Suitable subpads include polyurethane foam subpads (e.g., Poron® foam subpads from Rogers Corporation), impregnated felt subpads, microporous polyurethane subpads, or sintered urethane subpads. The subpad typically is softer than the polishing pad comprising the polishing pad substrate of the invention and therefore is more compressible and has a lower Shore hardness value than the polishing pad. For example, the subpad can have a Shore A hardness of about 35 to about 50. In some embodiments, the subpad is harder, is less compressible, and has a higher Shore hardness than the polishing pad. The subpad optionally comprises grooves, channels, hollow sections, windows, apertures, and the like. When the polishing pad of the invention is used in combination with a subpad, typically there is an intermediate backing layer such as a polyethyleneterephthalate film, coextensive with and between the polishing pad and the subpad.

Polishing pads comprising the polishing pad substrates of the invention are suitable for use in polishing many types of workpieces (e.g., substrates or wafers) and workpiece materials. For example, the polishing pads can be used to polish workpieces including memory storage devices, semiconductor substrates, and glass substrates. Suitable workpieces for polishing with the polishing pads include memory or rigid disks, magnetic heads, MEMS devices, semiconductor wafers, field emission displays, and other microelectronic substrates, especially microelectronic substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A chemical-mechanical polishing pad substrate comprising a porous material having an average pore size of about 0.01 microns to about 1 micron, wherein the polishing pad substrate has a light transmittance of about 10% or more at at least one wavelength of about 200 nm to about 35,000 nm.

2. The polishing pad substrate of claim 1, wherein the polishing pad substrate has a light transmittance of about 30% or more at at least one wavelength of about 200 nm to about 35,000 nm.

3. The polishing pad substrate of claim 1, wherein the average pore size is about 0.1 microns to about 0.7 microns.

4. The polishing pad substrate of claim 1, wherein the porous material has a density of about 0.5 g/cm$^3$ or greater.

5. The polishing pad substrate of claim 4, wherein the porous material has a density of about 0.7 g/cm$^3$ or greater.

6. The polishing pad substrate of claim 1, wherein the porous material has a void volume of about 90% or less.

7. The polishing pad substrate of claim 6, wherein the porous material has a void volume of about 25% or less.

8. The polishing pad substrate of claim 1, wherein the porous material comprises a polymer resin selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneterephthalate, polyimides, polyaramides, polyarylenes, polystyrenes, polymethylmethacrylates, copolymers thereof, and mixtures thereof.

9. The polishing pad substrate of claim 8, wherein the polymer resin is a thermoplastic polyurethane.

10. The polishing pad substrate of claim 1, wherein the porous material comprises a three-dimensional metal oxide network.

11. The polishing pad substrate of claim 1, wherein the substrate is a polishing pad.

12. The polishing pad substrate of claim 1, wherein the substrate is a polishing pad window.

13. A chemical-mechanical polishing apparatus comprising:

(a) a platen that rotates, (b) a polishing pad comprising the polishing pad substrate of claim 1, and (c) a carrier that holds a workpiece to be polished by contacting the rotating polishing pad.

14. The chemical-mechanical polishing apparatus of claim 13, further comprising an in situ polishing endpoint detection system.

15. A method of polishing a workpiece comprising (i) providing a polishing pad comprising the polishing pad substrate of claim 1, (ii) contacting a workpiece with the polishing pad, and (iii) moving the polishing pad relative to the workpiece to abrade the workpiece and thereby polish the workpiece.

* * * * *